US008466429B2

(12) United States Patent
Guethlein

(10) Patent No.: US 8,466,429 B2
(45) Date of Patent: Jun. 18, 2013

(54) PARTICLE BEAM INJECTOR SYSTEM AND METHOD

(75) Inventor: Gary Guethlein, Livermore, CA (US)

(73) Assignee: Lawrence Livermore National Security, LLC, Livermore, CA (US)

( * ) Notice: Subject to any disclaimer, the term of this patent is extended or adjusted under 35 U.S.C. 154(b) by 6 days.

(21) Appl. No.: 13/253,944

(22) Filed: Oct. 5, 2011

(65) Prior Publication Data

US 2012/0085920 A1 Apr. 12, 2012

Related U.S. Application Data

(60) Provisional application No. 61/390,529, filed on Oct. 6, 2010.

(51) Int. Cl.
*H01J 3/26* (2006.01)

(52) U.S. Cl.
USPC ..... 250/396 R; 250/492.3

(58) Field of Classification Search
USPC ..... 250/396 R, 492.3
See application file for complete search history.

(56) References Cited

U.S. PATENT DOCUMENTS 6,683,318 B1 * 1/2004 Haberer et al. ..... 250/492.3
7,098,615 B2 8/2006 Swenson et al.
2003/0048080 A1 3/2003 Amemiya et al.
2010/0133446 A1 6/2010 Balakin
2012/0126727 A1 * 5/2012 Hamm ..... 315/505

OTHER PUBLICATIONS

Hahto, et al., "Fast Ion Beam Chopping System for Neutron Generators", Review of Scientific Intruments, 76, 5 pages (2005).
Wiesner, et al., "A 250 kHz for Low Energy High Intensity Proton Beams", Proceedings of EPAC08, T12 Beam Injection/Extraction and Transport, pp. 3623-3625 (2008).
Kasjuwagi, et al., "Time Structure of an Accelerated Bean Using a Radio-Frequency Qyadropole Linac With Direct Plasma Injection Scheme", Review of Scientific Instruments, 81, 02B724, 4 pages (2010).

* cited by examiner

*Primary Examiner* — Kiet T Nguyen
(74) *Attorney, Agent, or Firm* — Perkins Coie LLP

(57) ABSTRACT

Methods and devices enable coupling of a charged particle beam to a radio frequency quadrupole accelerator. Coupling of the charged particle beam is accomplished, at least in-part, by relying on of sensitivity of the input phase space acceptance of the radio frequency quadrupole to the angle of the input charged particle beam. A first electric field across a beam deflector deflects the particle beam at an angle that is beyond the acceptance angle of the radio frequency quadrupole. By momentarily reversing or reducing the established electric field, a narrow portion of the charged particle beam is deflected at an angle within the acceptance angle of the radio frequency quadrupole. In another configuration, beam is directed at an angle within the acceptance angle of the radio frequency quadrupole by the first electric field and is deflected beyond the acceptance angle of the radio frequency quadrupole due to the second electric field.

27 Claims, 12 Drawing Sheets

(Prior Art)

PARTICLE BEAM INJECTOR SYSTEM AND METHOD

CROSS-REFERENCE TO RELATED APPLICATIONS

This application claims priority from U.S. Provisional Application No. 61/390,529, filed on Oct. 6, 2010, the entire contents of which is hereby incorporated by reference.

FEDERALLY SPONSORED RESEARCH OR DEVELOPMENT

The United States Government has rights in this invention pursuant to Contract No. DE-AC52-07NA27344 between the United States Department of Energy and Lawrence Livermore National Security, LLC for the operation of Lawrence Livermore National Laboratory.

TECHNICAL FIELD

The present application generally relates to particle accelerators, including linear particle accelerators that use dielectric wall accelerators.

BACKGROUND

Particle accelerators are used to increase the energy of electrically-charged atomic particles, e.g., electrons, protons, or charged atomic nuclei. High energy electrically-charged atomic particles are accelerated to collide with target atoms, and the resulting products are observed with a detector. At very high energies the charged particles can break up the nuclei of the target atoms or molecules and interact with other particles. Transformations are produced that help to discern the nature and behavior of fundamental units of matter. Particle accelerators are also important tools in the effort to develop nuclear fusion devices, as well as in medical applications such as proton therapy for cancer treatment.

Proton therapy uses a beam of protons to irradiate diseased tissue, most often in the treatment of cancer. The proton beams can be utilized to more accurately localize the radiation dosage and provide better targeted penetration inside the human body when compared with other types of external beam radiotherapy. Due to their relatively large mass, protons have relatively small lateral side scatter in the tissue, which allows the proton beam to stay focused on the tumor with only low-dose side-effects to the surrounding tissue.

The radiation dose delivered by the proton beam to the tissue is at or near maximum just over the last few millimeters of the particle's range, known as the Bragg peak. Tumors closer to the surface of the body are treated using protons with lower energy. To treat tumors at greater depths, the proton accelerator must produce a beam with higher energy. By adjusting the energy of the protons during radiation treatment, the cell damage due to the proton beam is maximized within the tumor itself, while tissues that are closer to the body surface than the tumor, and tissues that are located deeper within the body than the tumor, receive reduced or negligible radiation.

Proton beam therapy systems are traditionally constructed using large accelerators that are expensive to build and hard to maintain. However, recent developments in accelerator technology are paving the way for reducing the footprint of the proton beam therapy systems that can be housed in a single treatment room. Such systems often require newly designed, or re-designed, subsystems that can successfully operate within the small footprint of the proton therapy system, reduce or eliminate health risks for patients and operators of the system, and provide enhanced functionalities and features.

SUMMARY

Methods and devices enable coupling of a charged particle beam to a radio frequency quadrupole in particle acceleration systems and devices, including proton cancer therapy systems. Coupling of the charged particle beam is accomplished, at least in-part, by relying on of sensitivity of the input phase space acceptance of the radio frequency quadrupole to the angle of the input charged particle beam. A first electric field across a beam deflector causes the charged particle beam to have a first trajectory that is beyond the acceptance angle of the radio frequency quadrupole. By momentarily reversing or reducing the established electric field, a narrow portion of the charged particle beam is deflected from its initial first trajectory to a second trajectory that is within the acceptance angle of the radio frequency quadrupole.

One aspect of the present invention includes a method for coupling a charged particle beam to a radio frequency quadrupole (RFQ) that includes generating a first electric field across a particle beam deflector. The deflector is located at the entrance of the RFQ, and the first electric field causes the charged particle beam to have a first trajectory that is beyond an acceptance angle of the RFQ. This method further includes generating a second electric field for a predetermined duration, where the second electric field causes the charged particle beam to be deflected from the first trajectory to a second trajectory that is within the acceptance angle of the RFQ, thereby coupling the charged particle beam to the RFQ.

Another aspect of the present invention includes a method for coupling a charged particle beam to a radio frequency quadrupole (RFQ) that includes generating a first electric field across a particle beam deflector, where the deflector is located at the entrance of the RFQ, and the first electric field causes the charged particle beam to be delivered to the RFQ at an angle that is within an acceptance angle of the RFQ. The method also includes generating a second electric field for a predetermined duration, where the second electric field causes the charged particle beam to be deflected at an angle that is beyond the acceptance angle of the RFQ.

Another aspect of the present invention includes a device for coupling a charged particle beam to a radio frequency quadrupole (RFQ). The device comprises a particle beam deflector configured to deflect the charged particle beam at an angle that is beyond an acceptance angle of the RFQ when a first electric field is generated across the particle beam deflector, and to deflect the charged particle beam at an angle that is within the acceptance angle of the RFQ when a second electric field is generated across the particle beam deflector. This device also includes one or more voltage sources configured to supply voltages to the particle beam deflector for establishing the first and the second electric fields.

Another aspect of the present invention includes a device for coupling a charged particle beam to a radio frequency quadrupole (RFQ) that comprises a particle beam deflector configured to deliver the charged particle beam to the RFQ at an angle that is within an acceptance angle of the RFQ when a first electric field is generated across the particle beam deflector, and to deflect the charged particle beam at an angle that is beyond the acceptance angle of the RFQ when a second electric field is generated across the particle beam deflector. This device also includes one or more voltage sources configured to supply voltages to the particle beam deflector for establishing the first and the second electric fields.

DETAILED DESCRIPTION

Figure 1:
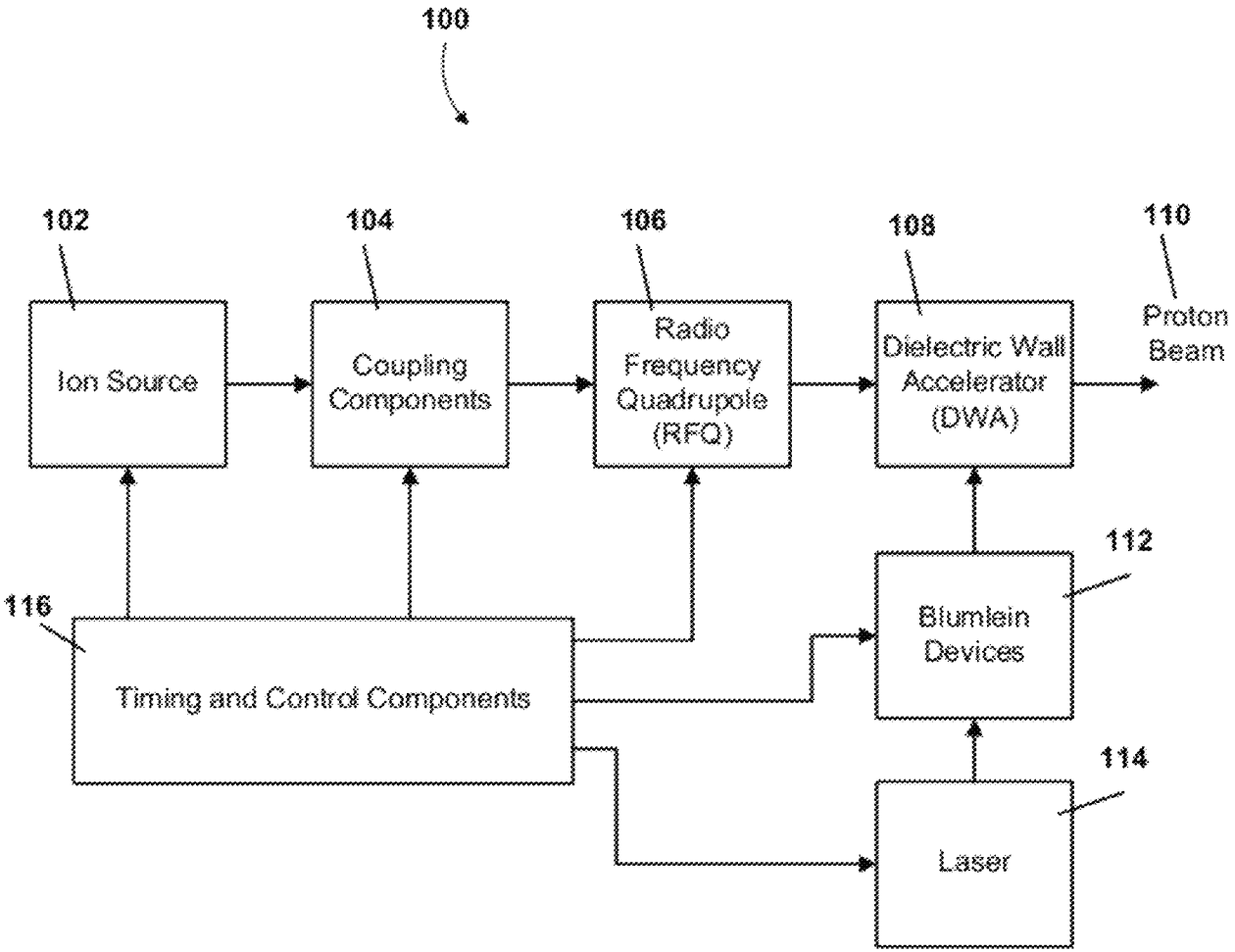
FIG. 1 is a block diagram of a linear particle accelerator that can accommodate the disclosed embodiments.

FIG. 1 illustrates a simplified diagram of a linear particle accelerator (linac) 100 that can be used to accommodate the disclosed embodiments. For simplicity, FIG. 1 only depicts some of the components of the linac 100. Therefore, it is understood that the linac 100 can include additional components that are not specifically shown in FIG. 1. An ion source 102 produces a charged particle beam that is coupled to a radio frequency quadrupole (RFQ) 106 using coupling components 104. The coupling components 104 can, for example, include components such as one or more Einzel lenses that provide a focusing/defocusing mechanism for the proton beam that is input to the RFQ 106. The coupling components 104 also include a beam deflection mechanism that is configured to allow selective coupling of the charged particle beam into the RFQ 106. Further details of the deflection mechanism are provided in the sections that follow. The RFQ 106 provides focusing, bunching and acceleration for the proton beam. One exemplary configuration of a radio frequency quadrupole includes an arrangement of four triangular-shaped vanes that form a small hole, through which the proton beam passes. The edges of the vanes at the central hole include ripples that provide acceleration and shaping of the beam. The vanes are RF excited to accelerate and shape the ion beam passing therethrough.

In the specific example in FIG. 1, the charged particle beam output by RFQ 106 is coupled to a dielectric wall accelerator (DWA) 108 that further accelerates the beam to produce an output charged particle beam, shown as an exemplary proton beam 110. FIG. 1 also shows Blumlein devices 112 and the associated laser 114 that are used to deliver voltage pulses to the DWA 108 by using the laser light to trigger switches for controlling the DWA 108. The timing and control components 116 provide the necessary timing and control signals to the various components of the linac 100 to ensure proper operation and synchronization of those components.

Figure 2A:
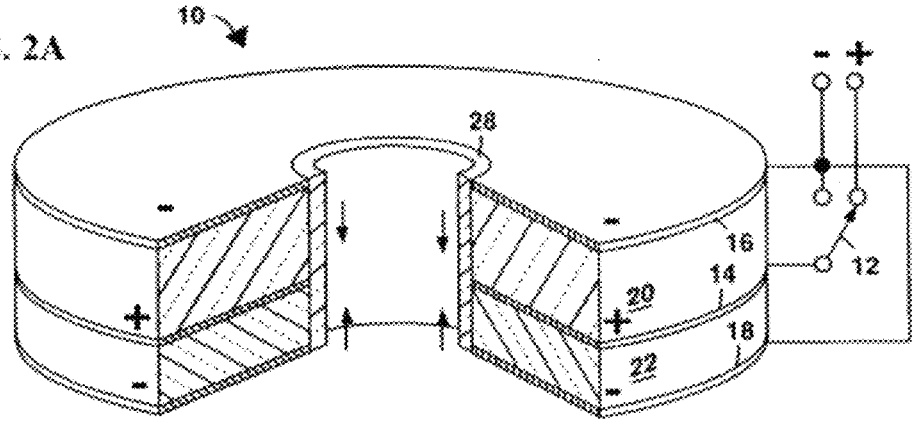
FIGS. 2A-2C illustrate the operations of a dielectric wall accelerator that can be used in conjunction with the disclosed embodiments.
Figure 2B:
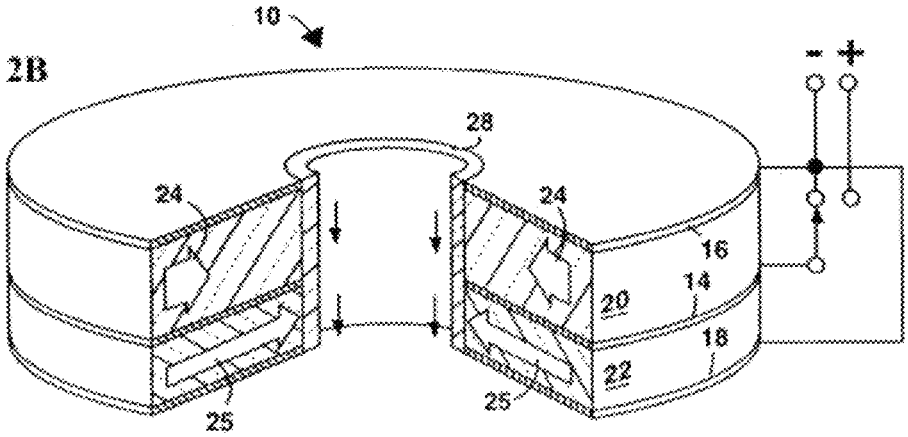
Figure 2C:
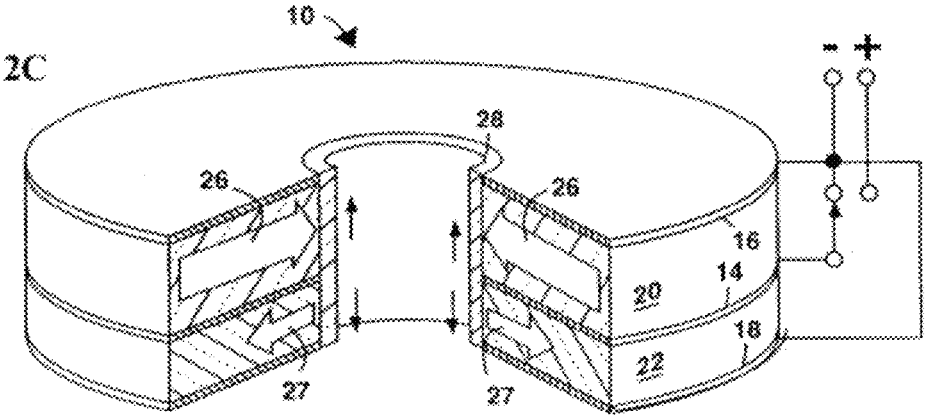

FIG. 2A, FIG. 2B and FIG. 2C provide exemplary diagrams that illustrate the operation of a single DWA cell 10 that can be utilized with the linac 100 of FIG. 1. FIGS. 2A-2C provide a time-series that is related to the state of a switch 12. As shown in FIGS. 2A-2C, a sleeve 28 fabricated from a dielectric material is molded or otherwise formed on the inner diameter of the single accelerator cell 10 to provide a dielectric wall of an acceleration tube. In some systems, the DWA uses high gradient insulators (HGI), which is a layered insulator composed for alternating conductors and dielectrics. The HGI is capable of withstanding high voltages generated by the Blumlein devices and, therefore, provides a suitable candidate for the dielectric wall of the accelerator tube. A particle beam is introduced at one end of the accelerator tube for acceleration along the central axis. The switch 12 is connected to allow the middle conductive plate 14 to be charged by a high voltage source. A laminated dielectric 20 with a relatively high dielectric constant separates the conductive plates 14 and 16. A laminated dielectric 22 with a relatively low dielectric constant separates the conductive plates 14 and 18. In the exemplary diagram of FIGS. 2A-2C, the middle conductive plate 14 is set closer to the bottom conductive plate 18 than to the top conductive plate 16, such that the combination of the different spacing and the different dielectric constants results in the same characteristic impedance on both sides of the middle conductive plate 14. Although the characteristic impedance may be the same on both halves, the propagation velocity of signals through each half is not the same. The higher dielectric constant half with laminated dielectric 20 is much slower. This difference in relative propagation velocities is represented by a short fat arrow 24 and a long thin arrow 25 in FIG. 2B, and by a long fat arrow 26 and a reflected short thin arrow 27 in FIG. 2C. In some systems, the Blumleins comprise a linear-folded arrangement with the same dielectric on both halves and different lengths from switch to gap.

In a first position of the switch 12, as shown in FIG. 2A, both halves are oppositely charged so that there is no net voltage along the inner length of the assembly. After the lines have been fully charged, the switch 12 closes across the outside of both lines at the outer diameter of the single accelerator cell, as shown in FIG. 2B. This causes an inward propagation of the voltage waves 24 and 25 which carry opposite polarity to the original charge such that a zero net voltage will be left behind in the wake of each wave. When the fast wave 25 hits the inner diameter of its line, it reflects back from the open circuit it encounters. Such reflection doubles the voltage amplitude of the wave 25 and causes the polarity of the fast line to reverse. For only an instant moment more, the voltage on the slow line at the inner diameter will still be at the original charge level and polarity. As such, after the wave 25 arrives but before the wave 24 arrives at the inner diameter, the field voltages on the inner ends of both lines are oriented in the same direction and add to one another, as shown in FIG. 2B. Such adding of fields produces an impulse field that can be used to accelerate a beam. Such an impulse field is neutralized, however, when the slow wave 24 eventually arrives at the inner diameter, and is reflected. This reflection of the slow wave 24 reverses the polarity of the slow line, as is illustrated in FIG. 2C. The time that the impulse field exists can be extended by increasing the distance that the voltage waves 24 and 25 must traverse. One way is to simply increase the outside diameter of the single accelerator cell. Another, more compact way is to replace the solid discs of the conductive plates 14, 16 and 18 with one or more spiral conductors that are connected between conductor rings at the inner and/or outer diameters.

Multiple DWA cells 10 may be stacked or otherwise arranged over a continuous dielectric wall, to accelerate the proton beam using various acceleration methods. For example, multiple DWA cells may be stacked and configured to produce together a single voltage pulse for single-stage acceleration. In another example, multiple DWA cells may be sequentially arranged and configured for multi-stage acceleration, wherein the DWA cells independently and sequentially generate an appropriate voltage pulse. For such multi-stage DWA systems, by timing the closing of the switches (as illustrated in FIGS. 2A to 2C), the generated electric field on the dielectric wall can be made to move at any desired speed. In particular, such a movement of the electric field can be made synchronous with the proton beam pulse that is input to the DWA, thereby accelerating the proton beam in a controlled fashion that resembles a "traveling wave" that is propagating down the DWA axis. It is advantageous to make the duration of these pulses as short as possible since the DWA can withstand larger fields for pulses with narrow durations.

The disclosed embodiments facilitate the coupling of a charged particle beam to an RFQ in a linac system by producing narrow beam pulses with fast rise and fall times, while maintaining proper synchronization between the various components of the linac. To facilitate the understanding of the disclosed embodiments, consider an exemplary linac configuration in which an ion source produces a low energy proton beam (e.g., 35 keV) comprised of pulses with duration 5-20 μs, and an RFQ that operates at a frequency of 425 MHz. The low energy proton beam may be shaped with one or more Einzel lenses as part of the transport from the ion source to the RFQ. The normal output of the RFQ in such an exemplary configuration is typically a 5-10 μs train of micropulses, where each pulse is approximately 200-500 ps long and is separated from other pulses in the train by one RF period (i.e., 2.35 ns for the 425 MHz operating frequency).

According to some embodiments, a narrow portion of the proton beam generated by the ion source is coupled to the RFQ. In particular, the disclosed embodiments utilize a beam deflector (also referred to as a "kicker") that is placed at the entrance of the RFQ such that the RFQ is filled with a short proton beam for the duration of a single RF cycle (or period). The rise and fall times of the deflected proton pulse are sufficiently small to ensure that the beam injected into the RFQ substantially fills the complete RF cycle, while minimizing the spread into adjacent RF cycles. In order for the proton beam to be transported, accelerated and bunched by the RFQ, the beam must be matched to the RFQ's input acceptance. Such an acceptance can be characterized in a phase space comprising space, momentum, and/or angular coordinates. The beam deflection methodologies and mechanisms of the disclosed embodiments facilitate the slicing of a continuous low energy beam (or pulsed beams with long pulse widths) by exploiting, in-part, the sensitivity of the input phase space acceptance of the RFQ to the angle of the input beam.

Slicing a portion from a continuous beam is typically done using one or more deflection plates and physical apertures that are located between the ion source and the intended destination, which in this case would be the entrance to the RFQ. Such techniques use the physical boundary of the final aperture as a spatial acceptance to define the temporally selected beam. One problem associated with such techniques is that the transit time of the low energy beam (e.g., 35 keV beam) across the deflection plates is comparable or larger than the desired pulse width (e.g., 2.35 ns for an RFQ operating at 425 MHz). In these systems, the beam transport from the ion source to the RFQ also often passes through an Einzel lens to provide focusing. This transport mechanism produces further spread in transit times (e.g., in the order of a few nanoseconds) due to, for example, path length differences introduced by the Einzel lens. As such, even a perfect square voltage pulse that is applied to the deflection plates will result in a deflection that ramps up for approximately the proton transit time through the deflection plates. Therefore, such a configuration does not allow for maximal transmission into the RFQ during the intended pulse operation.

The above noted problems can be mitigated by placing at the RFQ entrance a beam deflector that is shorter than or comparable in length to the proton speed multiplied by the RFQ period. The beam deflector is configured to operate at a first DC bias level. The electric field that is generated due to the first DC bias level deflects the protons to modify their trajectory such that the modified trajectory is at an angle that is beyond the acceptance angle of the RFQ. Under these conditions (e.g., default conditions), the proton beam is not coupled to the RFQ. A narrow proton pulse, however, can be generated and directed to the RFQ (i.e., at an angle that is within the acceptance angle of the RFQ) by applying an impulse voltage to the beam deflector with an opposite polarity of the first DC bias level. The applied pulse momentarily modifies (e.g., negates) the electric field across the beam deflector, thereby allowing the proton beam to be coupled to the RFQ.

Figure 3A:
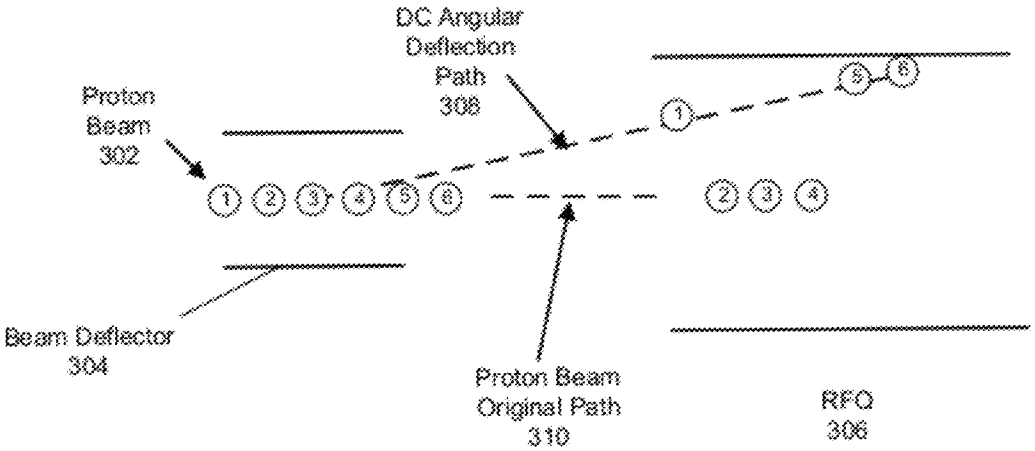
FIG. 3A illustrates a particle beam deflector in accordance with an example embodiment.
Figure 3B:
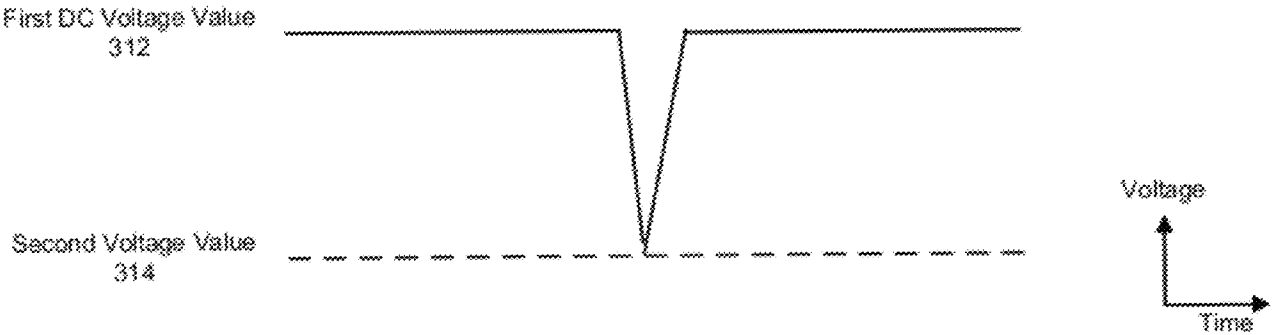
FIG. 3B illustrates first and second DC voltages produced across the particle beam deflector of FIG. 3A.

FIGS. 3A and 3B (referred together as "FIG. 3") schematically illustrate the operation of a beam deflector 304 in accordance with an exemplary embodiment. The beam deflector 304 is located at the entrance aperture of the RFQ 306 and is configured to allow a proton beam 302 to pass through the beam deflector 304. The beam deflector 304 can, for example, comprise two parallel plates that are coupled to a DC voltage supply. The proton beam 302, in the absence of a field across the beam deflector (e.g., a zero DC voltage value), traverses the proton beam original path (or trajectory) 310 upon entering the RFQ 306. In the exemplary embodiment of FIG. 3, a first DC voltage value 312 is applied to the beam deflector 304, establishing a first potential difference across the beam deflector 304 plates. The field that is generated across the beam deflector 304 by the first DC voltage value 312 causes the proton beam to have a first trajectory that is beyond the angular acceptance of the RFQ 306. This first trajectory may be considered a deflection from the proton beam original path 310 and is illustrated in FIG. 3A by portions of the proton beam, labeled as 1, 5 and 6, that follow the DC angular deflection path 308. As a result, when beam deflector 304 is biased with the first DC voltage value 312, the proton beam 302 fails to be accepted by, and further propagated through, the RFQ 306.

Upon application of a negative pulse to the beam deflector 304, the voltage across the beam deflector 304 is momentarily reduced to a second voltage value 314, which results in the elimination (or reduction) of the field across the beam deflector 304. As a result, the proton beam 302, for the duration of the negative pulse, follows the proton beam original path 310, entering the RFQ 306 at a second trajectory and angle (different from the first trajectory and angle) that is within the acceptance angle of the RFQ 306. This operation is shown in FIG. 3A by portions of the proton beam, labeled as 2, 3 and 4, that follow the proton beam original path 310. It should be noted that it is not necessary for the proton beam, upon the application of the negative voltage pulse, to precisely follow the proton beam original path 310. In fact, as long as the proton beam 302 is deflected at an angle within the acceptance angle of the RFQ 306, the protons can further propagate through the RFQ 306.

In one example, the first DC voltage value 312 is a positive voltage value and the second voltage value 314 is 0. In one variation of the above example, the second voltage value 314 is a positive voltage value smaller than the first DC voltage value 312. In still another variation, the second voltage value 314 is a negative voltage value. In another example, the first DC voltage value 312 is a negative value and the absolute value of the second voltage value 314 is smaller than the absolute value of the first DC voltage value 312. In another example embodiment, the first DC voltage value is zero, or is nearly zero, allowing the proton beam to have a trajectory that is outside of the acceptance angle of the RFQ, and the second voltage is non-zero valued, causing the proton beam to have a trajectory that is within the acceptance angle of the RFQ. The electric field established by the zero-valued (or nearly zero-valued) voltage source is a zero-valued (or nearly zero-valued) field.

By using a short impulse kicking voltage, as illustrated in FIG. 3B, all the protons between the deflection plates at the time of the impulse receive the same transverse kick and so the time width of kicked protons is the plate length divided by the proton speed. The duration of the impulse can be shorter than the one period of the RFQ. For instance, in one example embodiment, the impulse duration can be shorter than the RFQ period by less than one order of magnitude, while in other example embodiments, the impulse duration can be shorter than the RFQ period by one or more orders of magnitude. The pulse duration can also be longer (for example, comparable to the RFQ period) with slight reduction in kicking efficacy. In one example embodiment, with easily obtainable high voltage pulsers, the duration of the impulse is in the range 2.4 to 4.4 ns, with rise and fall times of about 200 ps. The duration of the proton pulses (i.e., the "kicked" protons or the proton "bunch") for such voltage pulse widths is given by the convolution of the voltage pulse width and the deflection plate length divided by the proton speed. To preserve the narrow proton pulse width, the deflection plates are mounted right at the RFQ entrance. As such, the angular acceptance of the RFQ determines the beam that is accelerated by the RFQ, without requiring a physical aperture between the ion source and the RFQ. By placing the beam deflector just prior to the RFQ entrance, the path length differences for all proton trajectories that are coupled to the RFQ are only in the order of a few picoseconds, due to the proximity of the beam deflector and the RFQ entrance and the uniformity of proton speed in this region. The exemplary configuration of FIG. 3 is capable of producing proton pulses at least in the range 2-2.5 ns in duration. As noted earlier, a cycle of an RFQ that operates at 425 MHz is 2.35 ns.

Figure 4A:
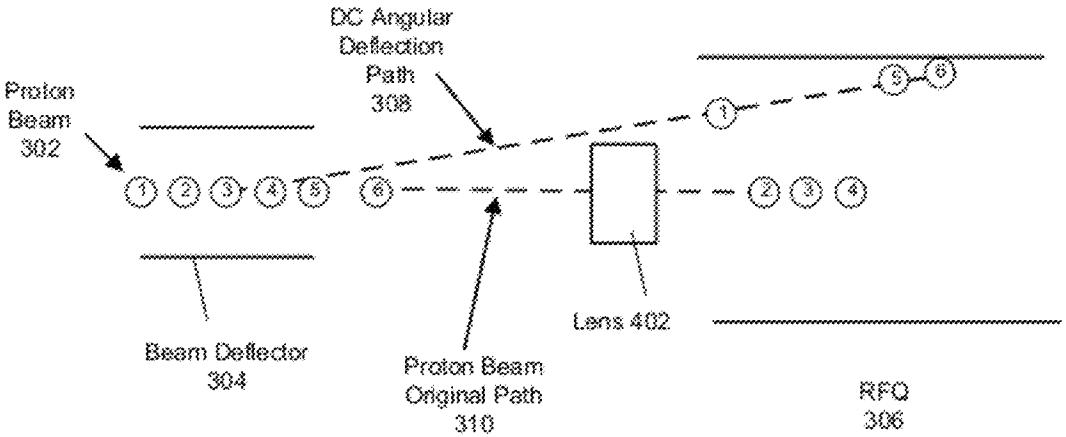
FIG. 4A illustrates a particle beam deflector in accordance with another example embodiment.
Figure 4B:
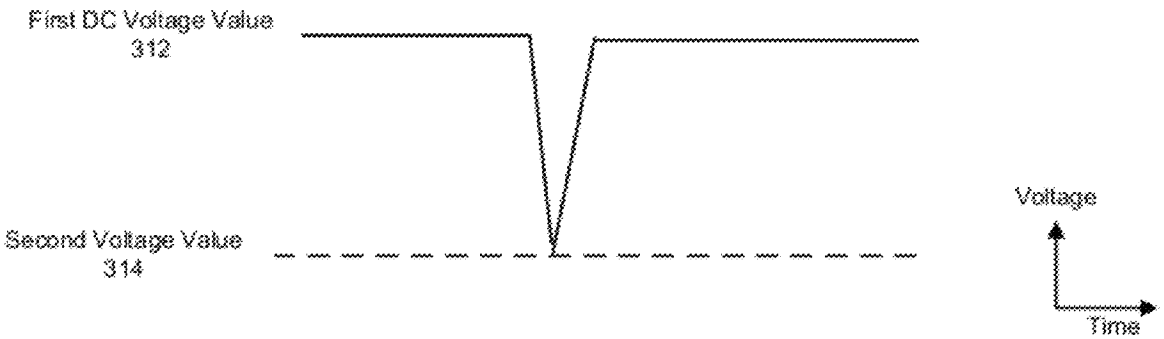
FIG. 4B illustrates first and second DC voltages produced across the particle beam deflector of FIG. 4A.

Another feature of the exemplary beam deflection system that is depicted in FIG. 3 or FIGS. 4A and 4B (referred together as "FIG. 4") is that normal operation of the linac (i.e., without the beam deflection mechanism) can be maintained by simply applying no voltage to the beam deflector. In this scenario, the proton beam is not deflected at all and, therefore, traverses its original trajectory into the RFQ.

In some example embodiments, a voltage pattern inverse to that shown in FIG. 3 or 4 is used. In particular, such an inverse voltage pattern can include a first DC bias level near zero that is used to allow the proton beam to be accepted by the RFQ during nominal or default operation. In such an exemplary, embodiment, an arbitrary number of pulses can be applied to the beam deflector to deflect the charged particle beam outside of the acceptance angle of the RFQ. Such an inverse pattern in sometimes referred to as a notch pattern or notch configuration.

In another exemplary embodiment that is shown in FIG. 4, in order to keep the beam diameter small inside the beam deflector 304, and small at the RFQ 306 entrance, an Einzel lens 402 is placed between the beam deflector 304 and the RFQ 306 entrance. In one example, the Einzel lens 402 is a "Accel-Decel" type (e.g., powered electrode negative) that provides defocusing-focusing of the beam. Since the proton beam is kept small throughout the lens 402, the path difference introduced by the lens is also small (e.g., in the order of about 100 ps). In such a configuration that includes the lens 420, the first applied DC voltage value 312 that corresponds to the RFQ "off" state may need to be adjusted, and/or the location of the lens 402 may need to be fine-tuned, to ensure that the protons associated with the off state reach the RFQ 306 entrance plane at an angle that is beyond the acceptance angle of the RFQ 306.

Figure 5:
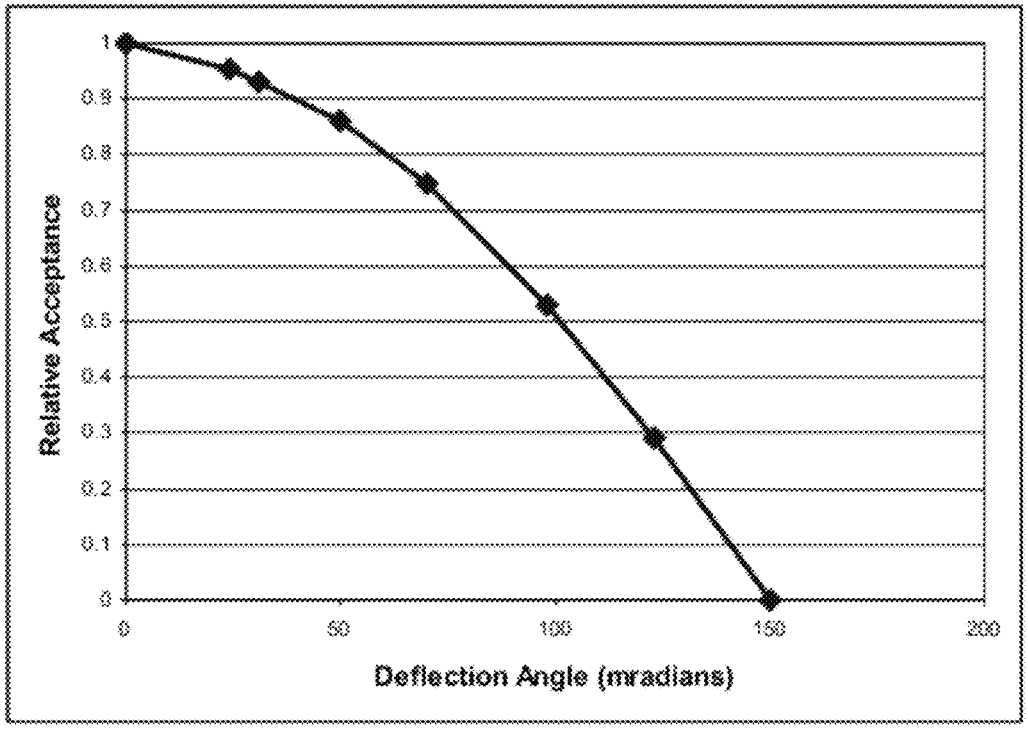
FIG. 5 illustrates a plot of angular acceptance of a radio frequency quadrupole as a function of deflection angle in accordance with an exemplary embodiment.

FIG. 5 is an exemplary plot of the relative acceptance of the proton beam at by the RFQ as a function of deflection angle of the proton beam. The plot in FIG. 5 has been produced for an exemplary RFQ. The plot in FIG. 5 illustrates that as the deflection angle moves from 0 to about 150 mradians, the relative acceptance of the proton beam (i.e., the ratio of proton beam at a particular deflection angle divided by the proton beam at zero deflection angle) at the RFQ entrance moves from 1 (i.e., 100% acceptance) to 0. As the deflection angle is increased beyond about 150 mradians, the relative acceptance remains at zero. As evident from the plot of FIG. 5, the RFQ acceptance is quite sensitive to the deflection angle that is produced by the beam deflector. As such, even a small angular deflection (e.g., beyond 150 mradians) can prevent the proton beam from being accepted (and accelerated) by the RFQ. It should be noted that the plot of FIG. 5 is provided for illustrative purposes. As such, the acceptance angle of the RFQ may span a different range of angles, or exhibit different fall-off characteristics, than what is shown in FIG. 5, depending on the particular configuration of linac components and the proton beam. It should be also noted that the acceptance angle of the RFQ may be the same or different in X and Y directions (X and Y directions are identified with respect to RFQ phase space).

The duration of the "kick" that is applied to the beam deflector in accordance with certain embodiments is selected to be roughly equal to the desired proton pulse length (e.g., 2.35 ns corresponding to 425 MHz RFQ operating frequency). In an optimal scenario, the kicking voltage would be an impulse (short relative to the time of proton transit through the deflection plates) applied to plates of length equal to the low energy proton speed multiplied by the desired pulse length. Thus all protons between the beam deflector plates receive the same kick and could all then optimally match the RFQ acceptance for maximal transmission and minimal spillage into neighboring RFQ cycles. However, the generation of a true high voltage impulse may not be feasible due to limitations in the various impulse generation technologies. For example, in certain commercially available technologies, pulses with full-width-half-maximum (FWHM) values of about 500 ps can readily be produced, but at higher unit cost. However, it is understood that the disclosed embodiments are applicable to future systems that can produce high voltage impulses of much narrower FWHM. Such optimal impulse kicking also requires minimizing the fringe (or edge) fields of the deflection plates that is described in the following section.

Another consideration in designing the beam deflection systems of the present application is the fringe (or edge) field effects. In particular, the electric field strength at the edges of the deflection plates may be different from the field strength at the center of the plates. This non-uniformity in electric field may result in a non-uniform kick, as protons that are located within the edge field may receive a weaker kick than those at the center of the plates. As a result, the rise time of the deflection is further increased. According to an example embodiment, the edge effects are reduced by narrowing the separation between the deflection plates. In another example embodiment, the edge effects are mitigated by shaping the deflection plates to reduce the field non-uniformity and produce a beam profile that resembles a "flattop." In the latter example, the deflection plates are shaped to produce a non-uniform electric field that compensates (e.g., negates) the non-uniformities that exist in electric field of the parallel plate configuration.

To preserve the rise time of the voltage pulse, either coaxial cables or stripline transmission lines that are matched to the impedance of the pulse generator may be used to deliver the voltages to the beam deflector plates. Further, the plates of the beam deflector can be matched to the transmission line, and the DC blocks may be impedance matched.

Figure 6:
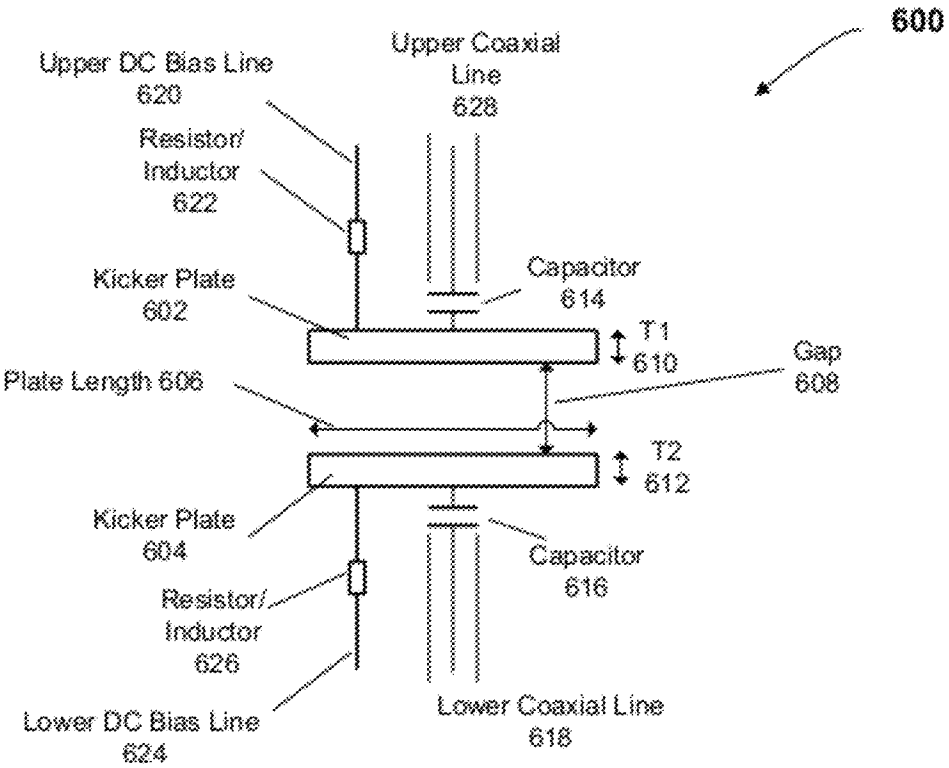
FIG. 6 illustrates a parallel plate particle beam deflector in accordance with an exemplary embodiment.

FIG. 6 illustrates an exemplary beam deflector 600 configuration in accordance with an exemplary embodiment. The beam deflector 600 configuration is not drawn to scale and may include fewer or additional components that are not depicted in the exemplary schematic of FIG. 6. FIG. 6 illustrates two parallel kicker plates 602 and 604 that are separated by a gap 608. While in one exemplary embodiment, both kicker plates have the same thickness, in the most general configuration, the upper kicker plate thickness T1 610 may be different from the lower kicker plate thickness T2 612. Each kicker plate 602 is further characterized by a plate length 606 and a plate area (not shown). The exemplary beam deflector 600 of FIG. 6 further includes capacitors 614 and 616, and an upper coaxial line 628 and a lower coaxial line 618 that provided connectivity for the upper 602 and the lower 604 kicker plates, respectively, to high voltage pulse generators. The placement of the blocking capacitors 614 and 616 close to the upper and lower kicker plates 602 and 604 further serves to preserve the shape of the RF pulse produced by the pulse generators. The pulse voltage nominally doubles at the plate since the kicker structure presents very little load to the coaxial line. The bias voltage to the beam deflector 600 is supplied via the upper DC bias voltage line 620 and the lower DC bias line 624 that are connected to the beam deflector plates 602, 604 through resistors and/or inductors 622, 626, respectively.

In one example embodiment, a beam deflector 600 with the following characteristics is constructed: the plate length 606 is 8 mm, the gap 608 is in 9 mm, the area of each kicker plate is 160 $mm^2$, the upper kicker plate thickness T1 610 and lower kicker plate thickness T2 612 are each 5.7 mm, the capacitors 614 and 616 are each 680 pF, the resistor/inductors 622 and 622 are each 1.5 MOhm. The above exemplary configuration of the beam deflector 600, when supplied with +6.2 kV and −6.2 kV on the lower DC bias line 624 and the upper DC bias line 620, respectively, and pulsed with a +3.7 kV and a −3.7 kV pulse of duration 2.5 (or 4 ns) ns on the upper coaxial line 628 and the lower coaxial line 618, respectively, is capable of producing a chopped proton beam with a duration of approximately 2.35 ns (or 4.7 ns), with rise and fall times below 500 ps. One or more DC voltage sources and one or more pulse generators may be used to supply the DC and pulse voltages. It should be noted that the above stated values are subject to manufacturers' and manufacturing tolerances. Further, in other embodiments, a beam deflector with different component values and sizes may be construed based on the disclosed principles. For example, in some embodiments, the configuration of the beam deflector can produce chopped particle beams with durations in the range 2 to 4.7 ns.

Synchronization between the various components of the linac is a critical factor for proper generation and control of the output proton beam. In the context of the exemplary linac of FIG. 1, such a synchronized operation must be maintained across multiple components, including the ion source 102, the RFQ 106 and the multi-stage DWA 108. In particular, the acceleration of the proton beam (or proton bunch) within the multi-stage DWA requires sequential charging and discharging of the Blumleins and the associated lasers that is synchronized with at least the RFQ, as well as the beam deflector operation. In FIG. 1, the timing and control components 116 provide the necessary timing and synchronization control for the linac 100 components.

Figure 7:
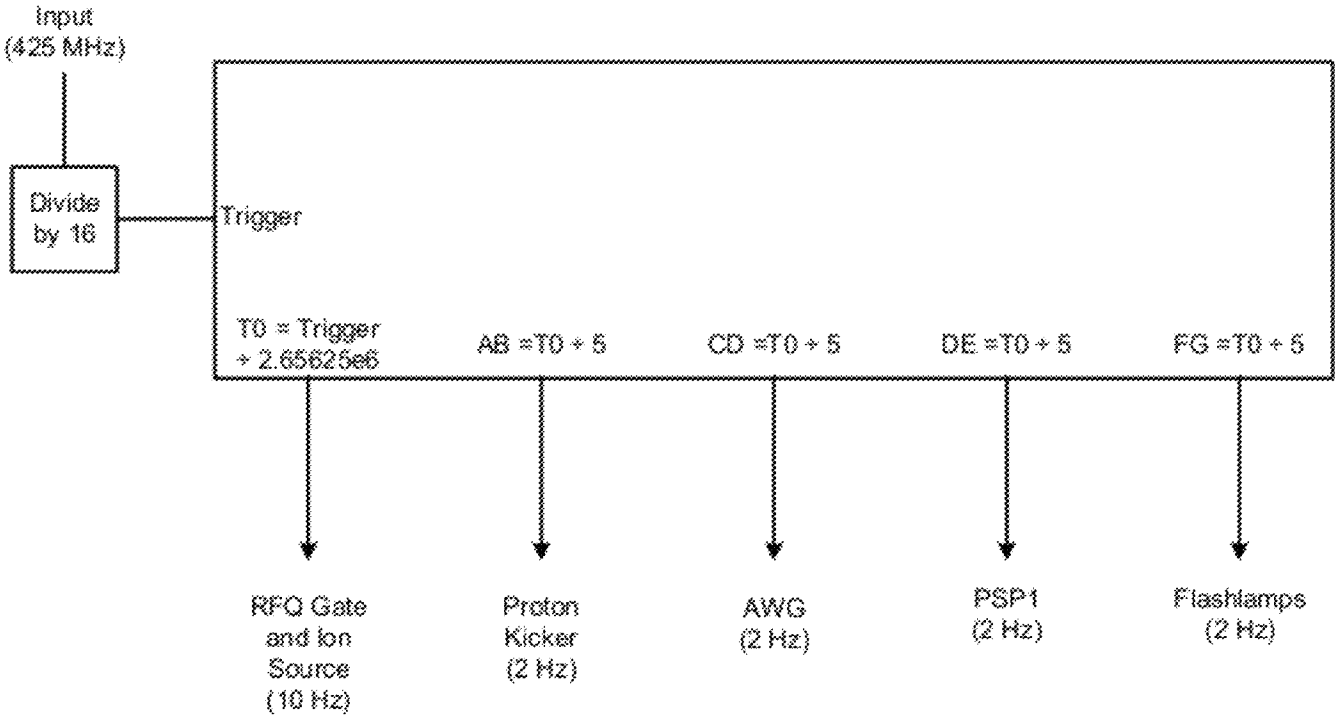
FIG. 7 illustrates a portion of a timing and synchronization component in accordance with an exemplary embodiment.

FIG. 7 illustrates a high level block diagram of a DG645 digital delay/pulse generator from Stanford Research Systems that can be used, at least in-part, to generate timing synchronization signals for the linac. The DG645 is a versatile digital delay/pulse generator that provides precisely defined pulses at repetition rates up to 10 MHz. DG645 is also capable of generating digital delays from 0 s to 2000 s, with 5 ps resolution. As illustrated in FIG. 7, a 425 MHz frequency signal (i.e., RF operating frequency of the RFQ) is divided by 16 and used as the external trigger. There are five front-panel outputs in DG645: T0, AB, CD, EF and GH. T0 is used to operate as the RFQ gate signal and ion source trigger, and is generated by dividing the trigger signal by 2,656,250. AB, CD, EF and GH are all 2 Hz signals that can be used to provide triggers for the proton kicker, arbitrary waveform generator (AWG), and a Pockels cell pulser (Kentech PSP1 pulser), and flashlamps, respectively. The AWG, the PSP1, and the flashlamps are used for operating the Q-switched lasers associated with Blumleins.

Figure 8:
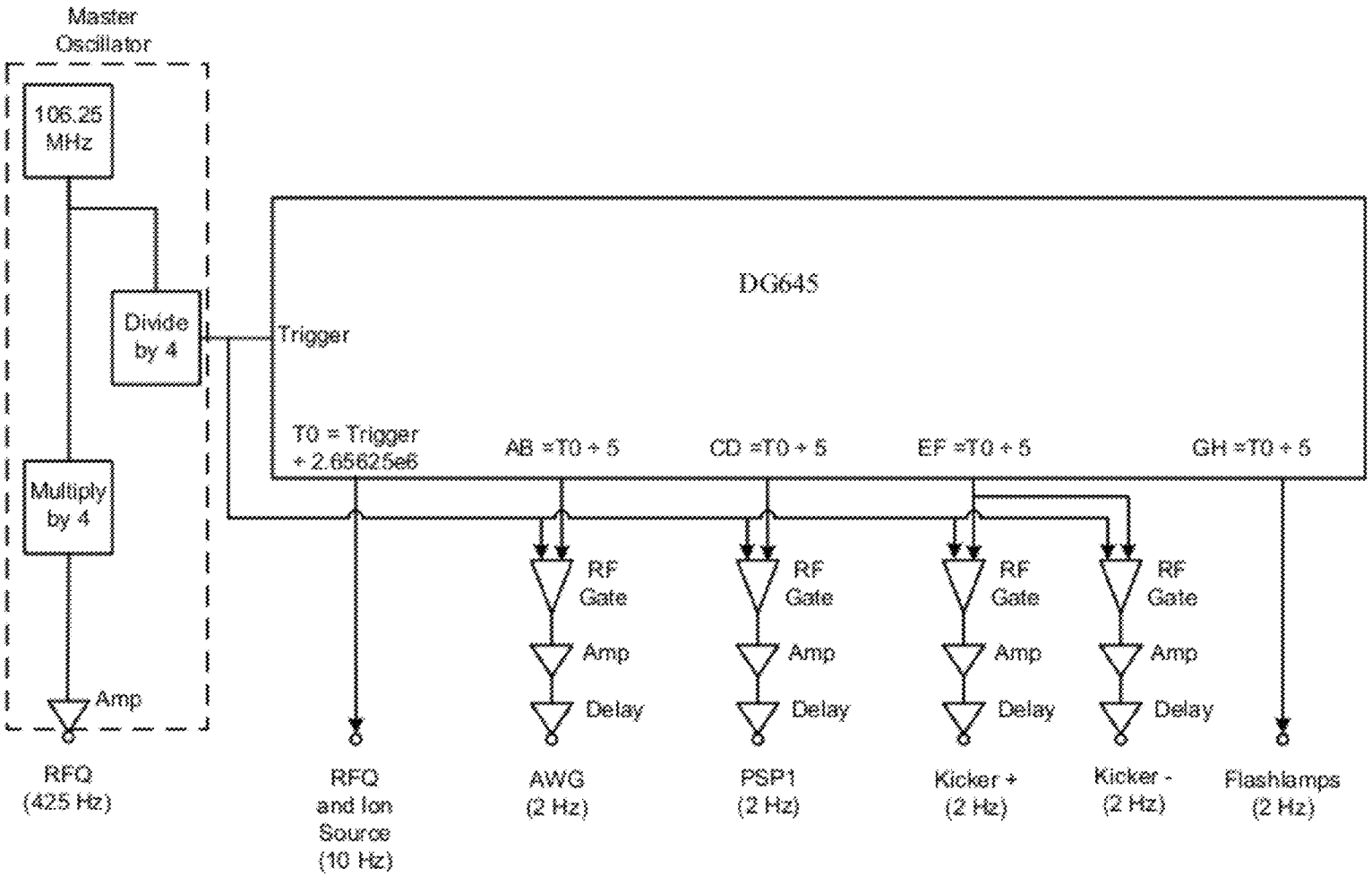
FIG. 8 illustrates a portion of a timing and synchronization component in accordance with another exemplary embodiment.

The DG645 has 100-200 ps timing jitter. In one embodiment, the jitter performance of the trigger signals is improved by utilizing a gating mechanism. FIG. 8 illustrates another high level block diagram of a low jitter timing system utilizing a DG645 digital delay/pulse generator in accordance with an exemplary embodiment. In the exemplary embodiment of FIG. 8, in the master oscillator section, a 106.25 MHz signal is divided by four to provide a 26.5625 MHz frequency signal (i.e., $1/16^{th}$ of the RF operating frequency of the RFQ) as the external trigger. The 106.25 MHz signal is also multiplied by four to provide the 425 MHz operating frequency of the RFQ. In the illustration, AB, CD, and EF are used to gate the 26.5625 MHz RF for generation of precision triggers. The resulting triggers have immeasurable (e.g., less than 5 ps) jitter relative to the RF signal due to RF gating that uses the input trigger itself. After the RF gate, the output of the RF gates associated with AB, CD, and EF can go through amplifiers (amp), followed by analog delay lines. Analog delays preserve the low jitter to deliver triggers for the AWG, PSP1 and the proton kicker. The proton kicker may be provided with a positive and a negative kicker impulse, as illustrated in FIG. 8. The flashlamp trigger is provided by GH.

In one embodiment, the timing and control components 116 of FIG. 1 utilize the particular timing signals depicted in FIGS. 7 and 8 to synchronize the linac 100 components with the 425 MHz clock. Once the ion source is turned on and stabilized, the beam deflector or kicker slices a portion of the proton beam that is coupled to the RFQ. The RFQ requires about 10 μs to fill and stabilize. The transit time through the RFQ is about 300 ns and the ion pulse output by the RFQ is about 200 ps long. The DWA is energized by sequential charge and discharge of Blumleins using laser-driven photo switches, which in turn causes the proton pulse to accelerate and propagate down the DWAs' central cavity. According to the disclosed embodiments, the arrival of the proton pulse at the DWA and the laser pulse to photo switches are synchronized to within 20 ps. Further, the kicker trigger signal is activated within several hundred ns of the laser trigger signal, with a jitter of less than 20 ps.

Figure 9:
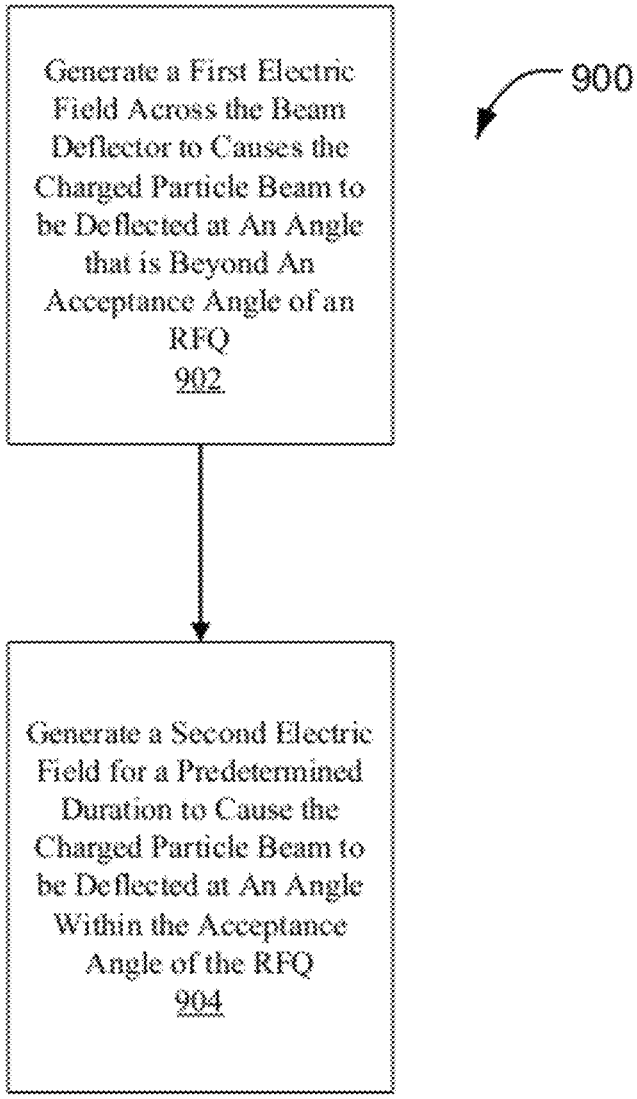
FIG. 9 illustrates a set of exemplary operations that can be used to couple a charged particle beam to a radio frequency quadrupole in accordance with an exemplary embodiment.

FIG. 9 illustrates a set of exemplary operations 900 that may be carried out to couple a charged particle beam to an RFQ in accordance with an exemplary embodiment. At 902, a first electric field across the beam deflector is generated to causes the charged particle beam to be deflected at an angle that is beyond an acceptance angle of the RFQ. For example, such a first electric field may be generated by establishing a voltage difference across the beam deflector plates. At 904, a second electric field is generated for a predetermined duration to cause the charged particle beam to be deflected at an angle within the acceptance angle of the RFQ. The second electric field can be generated by, for example, applying a voltage pulse with a peak voltage value that is opposite in polarity to the existing voltage difference across the beam deflector plates. As a result, a portion of the charged particle beam is coupled to the RFQ input based on angular acceptance of the RFQ. Relying on angular acceptance, as opposed to spatial acceptance, of the RFQ enables coupling of the charged particle beam into the RFQ without utilizing a physical aperture that can blur the edges and increase the rise/fall time of the beam that is input to the RFQ.

In one example embodiment, the above noted set of operations includes using two substantially parallel plates as part of the particle beam deflector, configuring the two substantially parallel plates to allow propagation of the charged particle beam through the plates, and establishing a first voltage difference across the plates to generate the first electric field. Such an example embodiment can also include applying a voltage pulse of a second voltage value that is opposite in polarity to the first voltage difference to generated the second electric field. Further, the absolute value of the second voltage value can be selected to be one of: a value that is less than absolute value of the first voltage difference, a value that is equal to absolute value of the first voltage difference, and a value that is greater than absolute value of the first voltage difference.

According to another embodiment, the duration of the coupled charged particle beam is substantially equal to one period of RFQ's operating radio frequency. In the example, embodiment, where the second electric field is generated by applying a voltage pulse of a second voltage value that is opposite in polarity to the first voltage difference, the duration of the voltage pulse can be in a range 2 to 4.7 nanoseconds, and the RFQ operates at 425 MHz. According to an example embodiment, the charged particle beam is a proton beam.

In another example embodiment, the particle beam deflector is configured to reduce non-uniformities of one or both of the first and the second electric fields. For example, the particle beam deflector can include two plates that are configured to allow propagation of the charged particle beam through the plates, where the first electric field is generated by establishing a first voltage difference across the plates and the second electric field is generated by establishing a second voltage difference across the plates. In this example, at least one of the plates can include a non-uniform surface area adapted to reduce the non-uniformities of the first and/or the second electric fields.

In yet another example embodiment, a lens can be used that is located between the particle beam deflector and entrance of the RFQ to focus the charged particle beam that is deflected within the acceptance angle of the RFQ. In another embodiment, timing synchronization is maintained with operations of at least an ion source, the RFQ, a dielectric wall accelerator (DWA), a Blumlein device and a laser.

In still another embodiment, a device for coupling a charged particle beam to a radio frequency quadrupole (RFQ) is provided. Such a device includes a particle beam deflector that is configured to deflect the charged particle beam at an angle that is beyond an acceptance angle of the RFQ when a first electric field is generated across the particle beam deflector. The particle beam deflector is further configured to deflect the charged particle beam at an angle that is within the acceptance angle of the RFQ when a second electric field is generated across the particle beam deflector. The above noted device also includes one or more voltage sources that are configured to supply voltages to the particle beam deflector for establishing the first and the second electric fields.

In one example embodiment, the one or more voltage sources in the aforementioned device include at least one direct current (DC) voltage source configured to supply voltages to the particle beam deflector to generate the first electric field, as well as a pulse generator that is configured to supply one or more pulses of a predetermined duration to the particle beam deflector to generate the second electric field.

Figure 10:
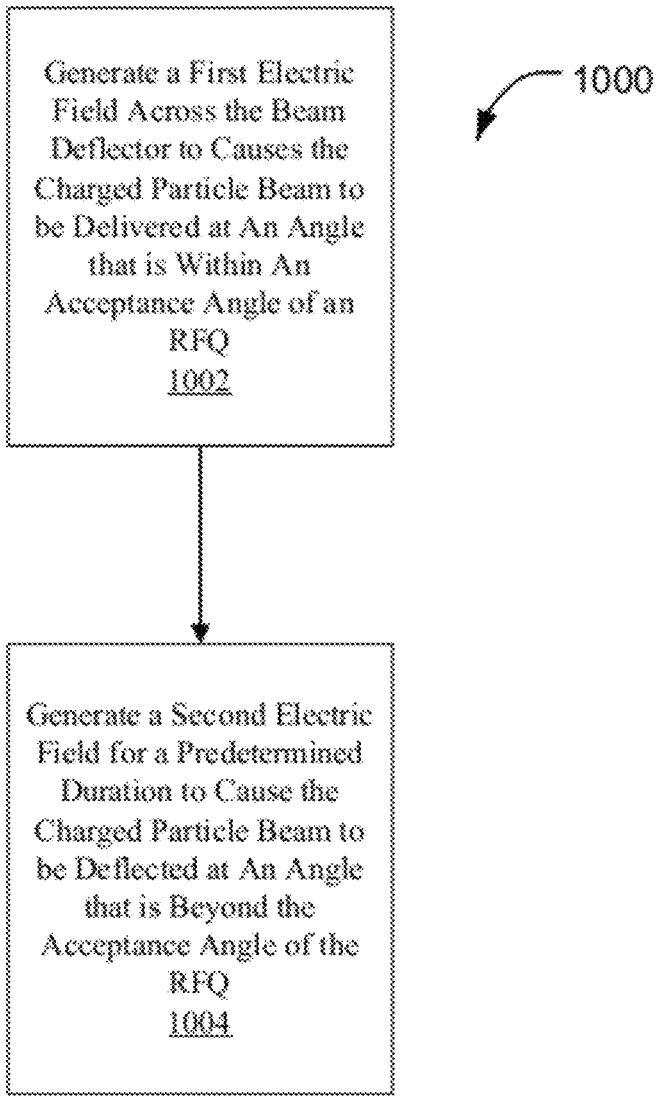
FIG. 10 illustrates a set of exemplary operations that can be used to couple a charged particle beam to a radio frequency quadrupole in accordance with another exemplary embodiment.

FIG. 10 illustrates a set of exemplary operations 1000 that may be carried out to couple a charged particle beam to an RFQ in accordance with an alternate exemplary embodiment. At 1002, a first electric field across the beam deflector is generated to cause the charged particle beam to be deflected at an angle that is within an acceptance angle of the RFQ. For example, such a first electric field may be generated by establishing a voltage difference across the beam deflector plates that is close to or equal to zero. At 1004, a second electric field is generated for a predetermined duration to causes the charged particle beam to be deflected at an angle that is beyond the acceptance angle of the RFQ. The second electric field can be generated by, for example, applying one or more voltage pulses. Such voltage pulses may have a positive or a negative peak voltage value for a particular duration such that the charged particle beam momentarily is deflected outside of the acceptance angel of the RFQ.

In some embodiments, one or more additional deflection mechanisms (e.g., deflection plates) can be located at one or both sides of the kicker to facilitate the deflection of the charged particle beam. For example, with reference to FIG. 3, a first set of additional parallel plates that are, for example, biased with a first DC voltage value 312 can be located at the left side of the depicted beam deflector 304 to deflect the beam at an angle that is outside of the acceptance angular range of the RFQ. In such an example embodiment, a voltage pulse that is applied to the kicker plates can deflect the charged particle beam at an angle that is within the acceptance angle of the RFQ. Additionally, or alternatively, a second set of additional plates can be located between the kicker plates and the RFQ to facilitate the deflection of the particle beam either alone, or in cooperation with the first set parallel plates and/or the kicker plates.

Figure 11:
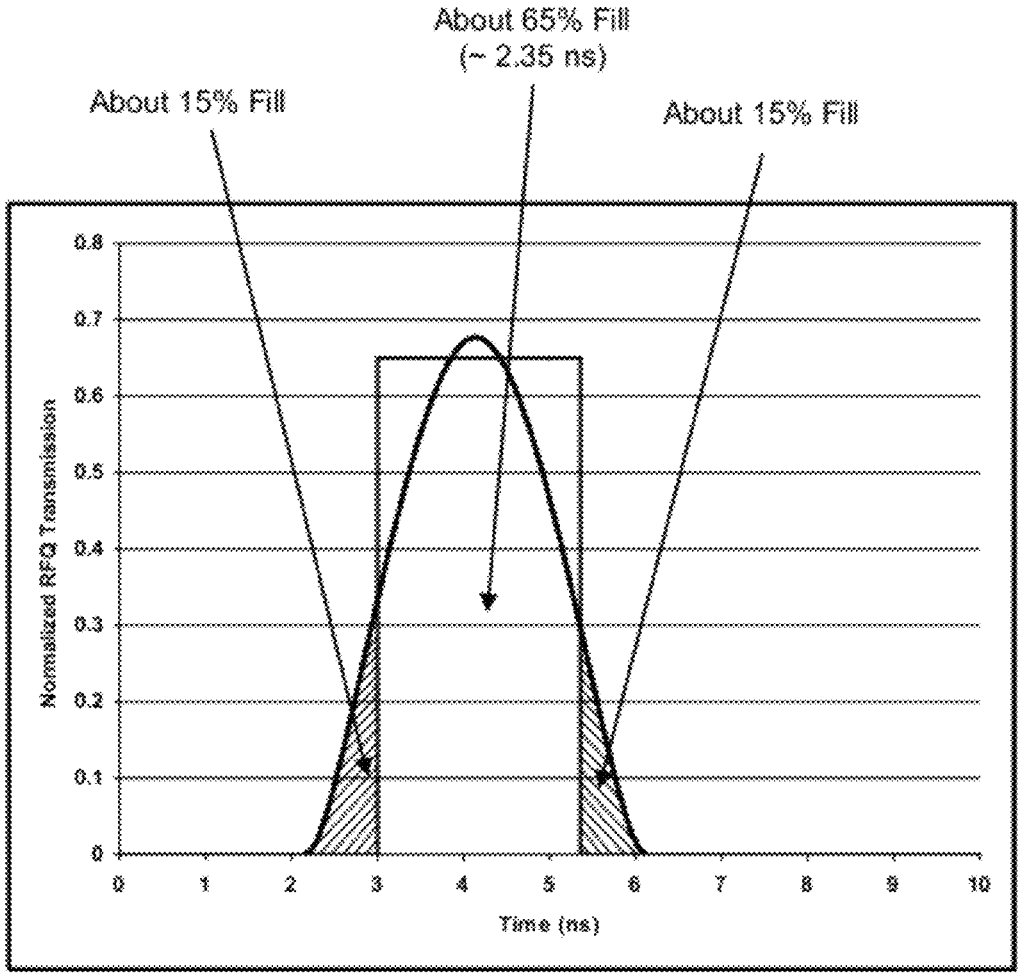
FIG. 11 is a simplified diagram of a proton beam spill-over in a radio frequency quadrupole adjacent cycles in accordance with an exemplary embodiment.

In certain configurations, a proton beam that is accepted by the RFQ may include additional protons that are coupled to adjacent RFQ cycles. This phenomenon is sometimes referred to as a "spill-over." In some applications, the existence of pre-pulse and post-pulse protons due to the spill-over may be tolerated. Therefore, in some embodiments where, for example, the existing state of the technology and/or implementation costs, make the generation of a singular proton bunch of a particular duration infeasible, the beam deflection components and the associated parameters may be designed to allow some spill over. Moreover, regardless of the state of technology or cost considerations, in applications that can tolerate spill-overs to adjacent RFQ cycles, the amount or percentage of spill-over can be used as another adjustable parameter to facilitate proper coupling of the proton beam to the RFQ. FIG. 11 illustrates an exemplary embodiment in which 65% of the proton charge is contained within the central RFQ cycle (e.g., 2.35 ns for 265 MHz operating frequency) with about 15% spill over to each of the adjacent cycles. In other exemplary embodiments, the spill-over can span fewer or more adjacent cycles than the ones illustrated in FIG. 11.

It is understood that the various embodiments of the present disclosure may be implemented individually, or collectively, in devices comprised of various hardware and/or software modules and components. In describing the disclosed embodiments, sometimes separate components have been illustrated as being configured to carry out one or more operations. It is understood, however, that two or more of such components can be combined together and/or each component may comprise sub-components that are not depicted. Further, the operations that are described in the form of the flow charts in FIGS. 9 and 10 may include additional steps that may be used to carry out the various disclosed operations.

Figure 12:
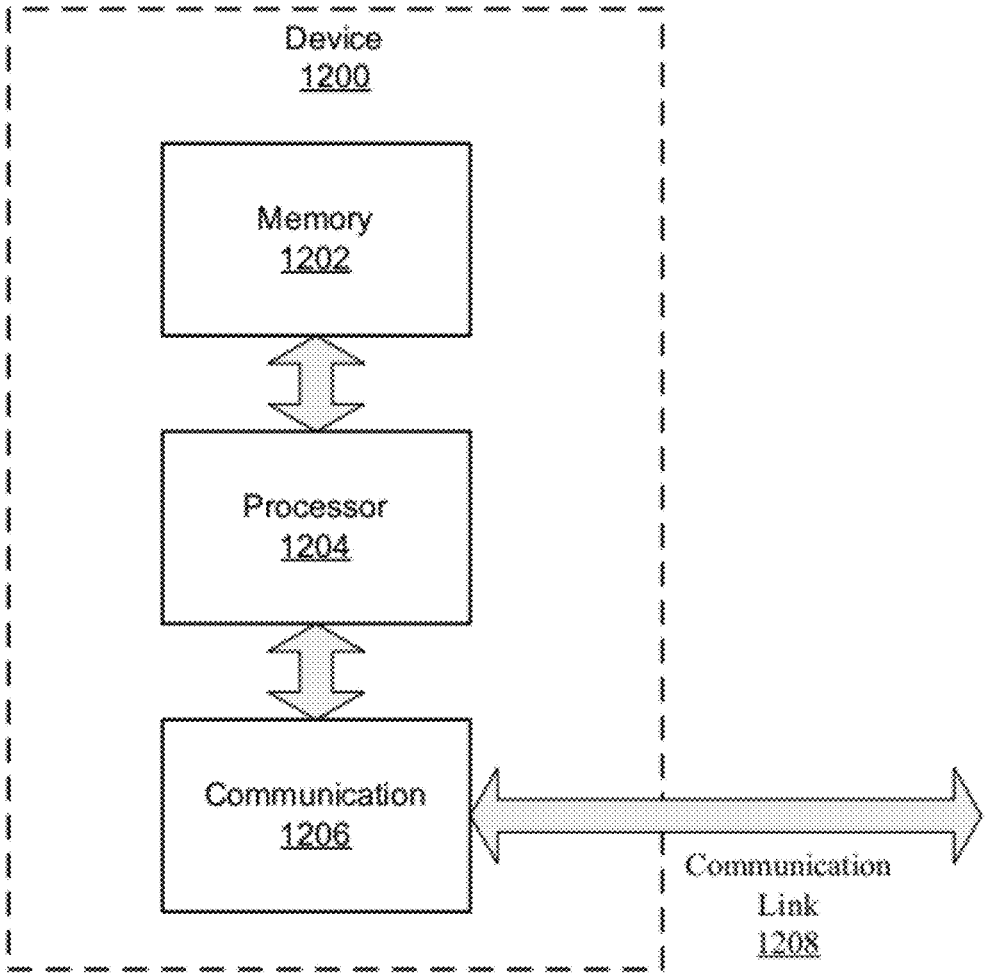
FIG. 12 illustrates a simplified diagram of a device that can be used to control the operations of the components of the disclosed embodiments.

In some examples, the devices that are described in the present application can comprise a processor, a memory unit and an interface that are communicatively connected to each other. For example, FIG. 12 illustrates a block diagram of a device 1200 that can be utilized as part of the timing and control components 116 of FIG. 1, or may be communicatively connected to one or more of the components of FIG. 1. The device 1200 comprises at least one processor 1202 and/or controller, at least one memory 1204 unit that is in communication with the processor 1202, and at least one communication unit 1206 that enables the exchange of data and information, directly or indirectly, through the communication link 1208 with other entities, devices, databases and networks. The communication unit 1206 may provide wired and/or wireless communication capabilities in accordance with one or more communication protocols, and therefore it may comprise the proper transmitter/receiver antennas, circuitry and ports, as well as the encoding/decoding capabilities that may be necessary for proper transmission and/or reception of data and other information.

Various embodiments described herein are described in the general context of methods or processes, which may be implemented in one embodiment by a computer program product, embodied in a computer-readable medium, including computer-executable instructions, such as program code, executed by computers in networked environments. A computer-readable medium may include removable and non-removable storage devices including, but not limited to, Read Only Memory (ROM), Random Access Memory (RAM), compact discs (CDs), digital versatile discs (DVD), Blu-ray Discs, etc. Therefore, the computer-readable media described in the present application include non-transitory storage media. Generally, program modules may include routines, programs, objects, components, data structures, etc. that perform particular tasks or implement particular abstract data types. Computer-executable instructions, associated data structures, and program modules represent examples of program code for executing steps of the methods disclosed herein. The particular sequence of such executable instructions or associated data structures represents examples of corresponding acts for implementing the functions described in such steps or processes.

The foregoing description of embodiments has been presented for purposes of illustration and description. The foregoing description is not intended to be exhaustive or to limit embodiments of the present invention to the precise form disclosed, and modifications and variations are possible in light of the above teachings or may be acquired from practice of various embodiments. The embodiments discussed herein were chosen and described in order to explain the principles and the nature of various embodiments and its practical application to enable one skilled in the art to utilize the present invention in various embodiments and with various modifications as are suited to the particular use contemplated. For example, the exemplary embodiments have been described in the context of proton beams. It is, however, understood that the disclosed principals can be applied to other charged particle beams. Moreover, the generation of extremely short charged particle pulses that are carried out in accordance with certain embodiments may be used in a variety of applications that range from radiation for cancer treatment, probes for spherical nuclear material detection or plasma compression, or in acceleration experiments. The features of the embodiments described herein may be combined in all possible combinations of methods, apparatus, modules, systems, and computer program products.

What is claimed is:

1. A method for coupling a charged particle beam to a radio frequency quadrupole (RFQ), comprising:

generating a first electric field across a particle beam deflector, wherein the deflector is located at the entrance of the RFQ, and the first electric field causes the charged particle beam to have a first trajectory that is beyond an acceptance angle of the RFQ; and generating a second electric field for a predetermined duration, wherein the second electric field causes the charged particle beam to be deflected from the first trajectory to a second trajectory that is within the acceptance angle of the RFQ, thereby coupling the charged particle beam to the RFQ.

2. The method of claim 1, comprising:

using two substantially parallel plates as part of the particle beam deflector;

configuring the two substantially parallel plates to allow propagation of the charged particle beam through the plates; and establishing a first voltage difference across the plates to generate the first electric field.

3. The method of claim 2, comprising applying a voltage pulse of a second voltage value that is opposite in polarity to the first voltage difference to generate the second electric field.

4. The method of claim 3, wherein absolute value of the second voltage value is selected to be one of:

a value that is less than absolute value of the first voltage difference;

a value that is equal to absolute value of the first voltage difference; and a value that is greater than absolute value of the first voltage difference.

5. The method of claim 1, wherein duration of the coupled charged particle beam is substantially equal to one period of RFQ's operating radio frequency.

6. The method of claim 3, wherein duration of the voltage pulse is shorter than one period of RFQ's operating frequency.

7. The method of claim 3, wherein duration of the voltage pulse is in a range 2 to 4.7 nanoseconds, and the RFQ operates at 425 MHz.

8. The method of claim 1, wherein the charged particle beam is a proton beam.

9. The method of claim 1, wherein the particle beam deflector is configured to reduce non-uniformities of one or both of the first and the second electric fields.

10. The method of claim 9, wherein the particle beam deflector comprises two plates configured to allow propagation of the charged particle beam through the plates;

the first electric field is generated by establishing a first voltage difference across the plates and the second electric field is generated by establishing a second voltage difference across the plates; and at least one of the plates comprises a non-uniform surface area adapted to reduce the non-uniformities of the first and/or the second electric fields.

11. The method of claim 1, further comprising using a lens located between the particle beam deflector and entrance of the RFQ to focus the charged particle beam that is deflected within the acceptance angle of the RFQ.

12. The method of claim 1, further comprising maintaining timing synchronization with operations of at least an ion source, the RFQ, a dielectric wall accelerator (DWA), a Blumlein device and a laser.

13. A method for coupling a charged particle beam to a radio frequency quadrupole (RFQ), comprising:

generating a first electric field across a particle beam deflector, wherein the deflector is located at the entrance of the RFQ, and the first electric field causes the charged particle beam to be delivered to the RFQ at an angle that is within an acceptance angle of the RFQ; and generating a second electric field for a predetermined duration, wherein the second electric field causes the charged particle beam to be deflected at an angle that is beyond the acceptance angle of the RFQ.

14. A device for coupling a charged particle beam to a radio frequency quadrupole (RFQ), comprising:

a particle beam deflector configured to cause the charged particle beam to have a first trajectory that is beyond an acceptance angle of the RFQ when a first electric field is generated across the particle beam deflector, and to deflect the charged particle beam from the first trajectory to a second trajectory that is within the acceptance angle of the RFQ when a second electric field is generated across the particle beam deflector; and one or more voltage sources configured to supply voltages to the particle beam deflector for establishing the first and the second electric fields.

15. The device of claim 14, wherein the one or more voltage sources comprise:

at least one direct current (DC) voltage source configured to supply voltages to the particle beam deflector to generate the first electric field; and at least one pulse generator configured to supply one or more pulses of a predetermined duration to the particle beam deflector to generate the second electric field.

16. The device of claim 14, wherein the particle beam deflector comprises two substantially parallel plates configured to allow propagation of the charged particle beam through the parallel plates to the RFQ entrance; and the beam deflector is configured to generate the first electric field by establishing a first voltage difference across the plates.

17. The device of claim 16, wherein at least one pulse generator is configured to supply a voltage pulse of a second voltage value that is opposite in polarity to the first voltage difference.

18. The device of claim 17, wherein absolute value of the second voltage value is selected to be one of:

a value that is less than absolute value of the first voltage difference;

a value that is equal to absolute value of the first voltage difference; and a value that is greater than absolute value of the first voltage difference.

19. The device of claim 1, wherein the beam deflector is configured to produce the coupled charged particle beam with a duration that is substantially equal to one period of RFQ's operating radio frequency.

20. The device of claim 17, wherein duration of the voltage pulse is shorter than one period of RFQ's operating frequency.

21. The device of claim 17, wherein duration of the voltage pulse is in a range 2 to 4.7 nanoseconds, and the RFQ operates at 425 MHz.

22. The device of claim 14, wherein the charged particle beam is a proton beam.

23. The device of claim 14, wherein the particle beam deflector is configured to reduce non-uniformities of one or both of the first and the second electric fields.

24. The device of claim 23, wherein the particle beam deflector comprises two plates configured to allow propagation of the charged particle beam through the plates;

the beam deflector is configured to generate the first electric field by establishing a first voltage difference across the plates and the second electric field by establishing a second voltage difference across the plates; and at least one of the plates comprises a non-uniform surface area adapted to reduce the non-uniformities of the first and/or the second electric fields.

25. The device of claim 14, further comprising using a lens located between the particle beam deflector and entrance of the RFQ, wherein the lens is configured to focus the charged particle beam that is deflected within the acceptance angle of the RFQ.

26. The device of claim 14, further comprising timing and control components configured to maintain synchronization with operations of at least: an ion source the RFQ, a dielectric wall accelerator (DWA), a Blumlein devices and a laser.

27. A device for coupling a charged particle beam to a radio frequency quadrupole (RFQ), comprising:

a particle beam deflector configured to deliver the charged particle beam to the RFQ at an angle that is within an acceptance angle of the RFQ when a first electric field is generated across the particle beam deflector, and to deflect the charged particle beam at an angle that is beyond the acceptance angle of the RFQ when a second electric field is generated across the particle beam deflector; and one or more voltage sources configured to supply voltages to the particle beam deflector for establishing the first and the second electric fields.

* * * * *